US007055224B2

(12) United States Patent
Bathey

(10) Patent No.: US 7,055,224 B2
(45) Date of Patent: Jun. 6, 2006

(54) TRASH BAG RETAINER

(75) Inventor: Richard A Bathey, Mission Viejo, CA (US)

(73) Assignee: WenDan Enterprises, Inc., Mission Viejo, CA (US)

( * ) Notice: Subject to any disclaimer, the term of this patent is extended or adjusted under 35 U.S.C. 154(b) by 37 days.

(21) Appl. No.: 10/118,838

(22) Filed: Apr. 9, 2002

(65) Prior Publication Data

US 2003/0188398 A1 Oct. 9, 2003

(51) Int. Cl.
*B65D 77/10* (2006.01)

(52) U.S. Cl. ..... 24/30.5 R; 248/101

(58) Field of Classification Search ..... 24/30.5 R, 24/17 B, 17 AP, 16 PB, 31 R, 68 R, DIG. 16; 248/101, 907

See application file for complete search history.

(56) References Cited

U.S. PATENT DOCUMENTS

| | | | | | |
|---|---|---|---|---|---|
| 3,614,041 | A | * | 10/1971 | Koger | 248/97 |
| 3,927,445 | A | * | 12/1975 | Pavlish | 24/482 |
| 3,928,893 | A | * | 12/1975 | Schmoller | 24/30.5 R |
| 3,958,785 | A | * | 5/1976 | Aboud | 294/1.1 |
| 4,287,701 | A | * | 9/1981 | Washington | 53/390 |
| 4,562,983 | A | * | 1/1986 | Klefbeck | 248/97 |
| 4,711,002 | A | * | 12/1987 | Kreeger | 24/30.5 P |
| 4,867,401 | A | * | 9/1989 | Graff | 248/99 |
| 4,899,967 | A | * | 2/1990 | Johnson | 248/97 |
| 4,925,056 | A | * | 5/1990 | McCoig | 220/495.1 |
| 5,033,703 | A | * | 7/1991 | Allen, Sr. | 248/97 |
| 5,082,219 | A | * | 1/1992 | Blair | 248/99 |
| D353,696 | S | * | 12/1994 | Spencer | D34/10 |
| 5,556,063 | A | * | 9/1996 | Boyd | 248/99 |
| 5,671,861 | A | * | 9/1997 | Hall et al. | 220/495.08 |
| 5,735,495 | A | * | 4/1998 | Kubota | 248/100 |
| 5,921,427 | A | * | 7/1999 | Giannone et al. | 220/495.06 |
| 6,056,147 | A | * | 5/2000 | Jarman | 220/495.11 |
| D457,283 | S | * | 5/2002 | Wayt | D34/6 |
| D468,506 | S | * | 1/2003 | Mitchell | D34/6 |
| 6,517,034 | B1 | * | 2/2003 | Kinchen | 248/99 |
| 2002/0003144 | A1 | * | 1/2002 | Grimes | 220/625 |

OTHER PUBLICATIONS

Trash Bag Retainer manufactured by ES & M Corp., Angola, IN.

* cited by examiner

*Primary Examiner*—Robert J. Sandy
*Assistant Examiner*—Andre L. Jackson
(74) *Attorney, Agent, or Firm*—Stetina Brunda Garred & Brucker

(57) ABSTRACT

A trash bag retainer for maintaining a trash bag within a receptacle having a wall which defines a top rim and inner and outer surfaces. The retainer comprises of an elongate band which defines an axis. Attached to the band is at least one engagement member which extends outwardly from the axis of the band. The engagement member defines at least one engagement surface, and is sized relative to the band such that a portion of the trash bag may be captured between the engagement surface and the outer surface of the wall when the band is extended about the receptacle, with a gap being defined between at least a portion of the band and the outer surface of the wall.

23 Claims, 3 Drawing Sheets

TRASH BAG RETAINER

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates generally to trash bag retainers, which prevent a trash bag from falling into a refuse container, and more particularly to a unique trash bag retainer capable of being positioned around the outer wall surface of the refuse container, wherein the trash bag retainer comprises at least one engagement member which inhibits the trash bag retainer from rolling down the refuse container, and which facilitates clearance between portions or segments of the trash bag retainer and the outer wall surface of the refuse container. The present invention also can be used on a wider variety of refuse container sizes and shapes, and it is also more aesthetically pleasing than trash bag retainers of the prior art.

Refuse containers are widely used to hold discarded trash. Typically, a trash or liner bag is placed in the refuse container, and the open, top portion of the trash bag is folded out and over the top lip or rim of the refuse container. Users place the trash bag inside the refuse container to inhibit stains from forming on the refuse container. Also, the trash bag provides a sanitary and convenient means for emptying the refuse container of trash.

Most trash bags are made of thin, light, and flexible material, such as plastic. As a result, the weight of the refuse itself often causes the trash bag to partially or completely fall inside the refuse container. Disadvantageously, a path opens for refuse to fall between the trash bag and the inner wall surface of the refuse container. Furthermore, since the inner wall surface of the refuse container is at least partially exposed, staining of the wall becomes possible. Also, when replacing a full trash bag which has fallen into the refuse container, users ordinarily have to reach into the refuse container to grab the trash bag, and thus risk contracting germs prevalent on the trash.

In order to inhibit the trash bag from falling into the refuse container, various trash bag retainers have been developed in the prior art. A typical trash bag retainer comprises an elastic band. The trash bag retainer is stretched over the outer wall surface of the refuse container, with the band being positioned over the lip of the refuse container, and about the trash bag. As such, the elasticity of the retainer holds the trash bag against the outer wall surface of the refuse container and inhibits the bag's ability to fall into the refuse container.

Current trash bag retainers possess inherent deficiencies which detract from their overall utility. For instance, refuse containers are often tapered, and since trash bag retainers typically have a circular cross sectional configuration, the trash bag retainer has a tendency to roll down the outer wall surface of the refuse container. Such roll-down also occurs even when the wall of the refuse container is not tapered. Unfortunately, the trash bag can fall into the refuse container once the trash bag retainer rolls down off of the trash bag.

Positioning conventional trash bag retainers on refuse containers can also be problematic. Many trash bag retainers are continuous bands, and positioning these types of retainers simply involves stretching the retainer around the outer wall surface of the refuse container. Although this process is simple, these continuous retainers often have relatively limited ranges of elasticity, and as a result, the retainer can fit over only a limited range of refuse container sizes. Other trash bag retainers are discontinuous lengths of elastic material, and are tied around the outer wall surface of the refuse container. Although these types of retainers initially might be used with a wider variety of container sizes, the assembly of these types of retainers is more time consuming. For instance, some non-continuous retainers are cut to length and then tied around the outer wall surface of the refuse container. Other non-continuous retainers are cut to length, with one end of the non-continuous retainer then being attached to the other end with a clip or other device. Again, this assembly process can be time consuming.

Moreover, conventional trash bag retainers often comprise a black, opaque rubber. This coloring causes the trash bag retainer to be aesthetically unpleasant, especially for users who leave the refuse container in open view.

Finally, when positioned about the wall of the refuse container, the elasticity of the trash bag retainer often results in the creation of a continuous seal between the trash bag and the outer wall surface of the refuse container. As such, air is often trapped between the inner wall surface of the refuse container and the trash bag. Disadvantageously, this trapped air takes up volume and thus limits the capacity of the trash bag.

Thus, it is appreciated that there is a need for a trash bag retainer that is a continuous band comprising an aesthetically pleasing material, wherein the retainer design has little tendency to roll down the wall of the refuse container or seal air between the inner wall surface of the refuse container and the trash bag.

BRIEF SUMMARY OF THE INVENTION

In accordance with the present invention, there is provided a trash bag retainer for maintaining a trash bag within a receptacle having a wall which defines a top rim and inner and outer surfaces. The retainer comprises an elongate band which defines an axis and is a continuous, unitary structure. Integrally connected to the band are a plurality of identically configured engagement members. The engagement members each preferably have a triangular configuration defining three engagement surfaces which are each laterally offset (i.e., disposed outwardly of) the axis of the band. The engagement members are preferably positioned in equidistantly spaced intervals along the band, and are sized relative thereto such that portions of the trash bag may be captured between one engagement surface of each of the engagement members and the outer surface of the wall when the band is extended about the receptacle. Additionally, due to the extension of the engagement members outwardly relative to the axis of the band, gaps are defined between those portions of the band extending between any adjacent pair of the engagement members and the outer surface of the wall.

The band may optionally be formed to include pairs of reinforcement portions which are disposed at respective ones of the opposed sides of each of the engagement members. Each of the engagement portions is of a mean diameter which exceeds the diameter of the remainder of the band. Both the band and the integral engagement members are preferably fabricated from resilient material possessing a high level of elasticity.

BRIEF DESCRIPTION OF THE DRAWINGS

These as well as other features of the present invention will become more apparent upon reference to the drawings wherein.

DETAILED DESCRIPTION OF THE INVENTION

Figure 1:
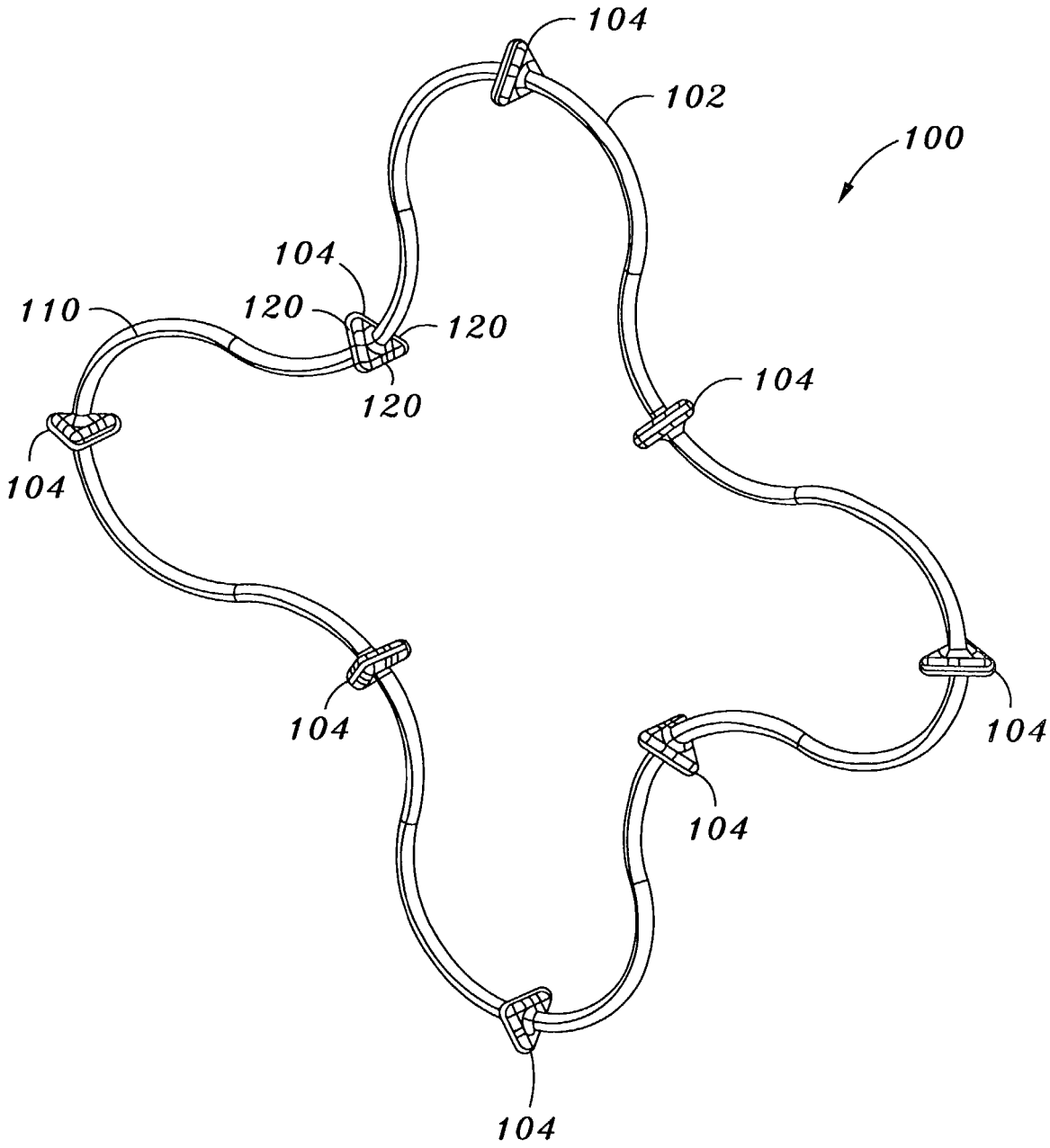
FIG. 1 is an isometric view of one embodiment of a trash bag retainer of the present invention.

Referring now to the drawings wherein the showings are for purposes of illustrating preferred embodiments of the present invention only, and not for purposes of limiting the same, FIG. 1 illustrates a trash bag retainer 100. As will be discussed in greater detail below, the trash bag retainer 100 is a continuous band comprising an aesthetically pleasing material, wherein the retainer design has little tendency to roll down the outer wall surface of the refuse container or trap air between the inner wall surface of the refuse container and the trash bag.

As shown in FIG. 1, the trash bag retainer 100 comprises an elongate band 102. The band 102 has a small, solid, circular cross section. In one embodiment, the diameter of the band 102 is about 0.13 inches. The band 102 defines an axis 110 which runs along the band 102 through the center of its circular cross section. Also, the band 102 is continuous (i.e., the band 102 has no beginning or end point). The band 102 is fabricated from an elastic material, and in one embodiment, comprises a material able to elongate up to one hundred percent (100%) of its length. To this end, the band 102 may be fabricated from Versaflex™, manufactured by GLS Corporation.

As will be discussed in greater detail below, when positioning the trash bag retainer 100 about a refuse container, the band 102 is stretched around the outer wall surface of the refuse container, and the elasticity of the band 102 causes the trash bag retainer 100 to hold a trash bag in place. Advantageously, because of the continuous design of the band 102, no cutting or assembling of the trash bag retainer 100 is necessary, making positioning of the trash bag retainer 100 very quick and simple. Additionally, because of the extreme elasticity of the band 102, the trash bag retainer 100 can be used with a wide variety of refuse container sizes and shapes.

As shown in FIG. 1, the trash bag retainer 100 also comprises a plurality of engagement members 104. The engagement members 104 are integrally attached to the band 102 in one embodiment, and are evenly or equidistantly spaced along the axis 110 of the band 102. Each engagement member 104 extends laterally outward from the axis 110 of the band 102. In the embodiment shown in FIG. 1, each engagement member's 104 cross section resembles an equilateral triangle, so as to define three sides 120, with the center point of each equilateral triangle being centered on the axis 110 of the band 102. In one particular embodiment, each of the three sides 120 of the typical engagement member 104 has a length of about 0.5 inches.

As will be described in greater detail below, when the trash bag retainer 100 is stretched around a refuse container, one side 120 of each engagement member 104 engages or contacts the trash bag. The flatness of the sides 120 of each of the engagement members 104 inhibits the trash bag retainer 100 from rolling down the outer wall surface of the refuse container. Furthermore, since the sides 120 of the engagement members 104 are disposed outwardly from the axis 110 of the band 102, clearance is created between the outer wall surface of the refuse container and those segments or sections of the band 102 extending between the engagement members 104. This clearance inhibits air from being sealed in between the inner wall surface of the refuse container and the trash bag, to thereby maintain the full capacity of the refuse container. These aspects of the trash bag retainer 100 will be explored in greater detail below.

Figure 2:
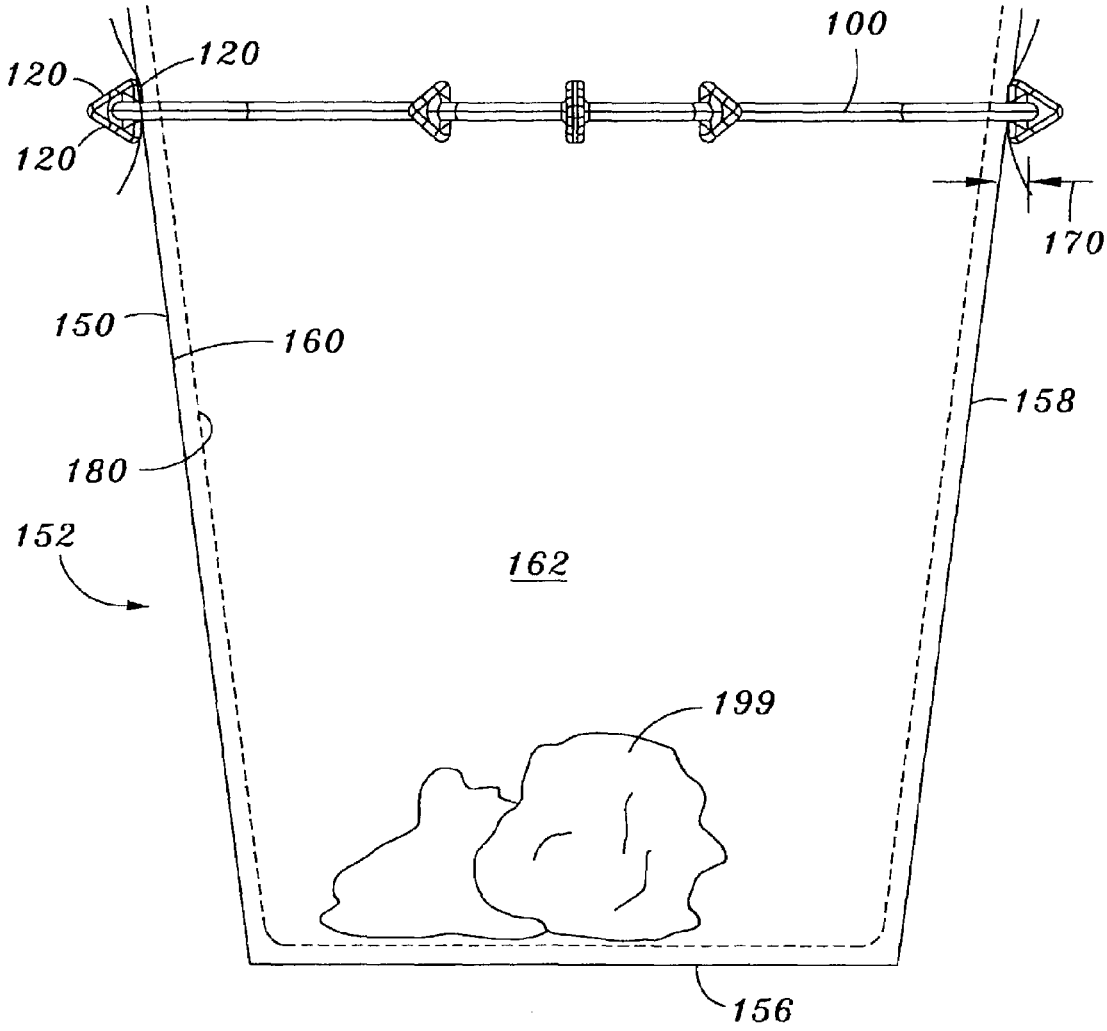
FIG. 2 is a side view of the trash bag retainer of FIG. 1 as fit around an exemplary refuse container.

Turning now to FIG. 2, a refuse container 152 is illustrated. As shown, the refuse container 152 comprises a wall 158, which forms a tapered, hollow cylinder, closed at a bottom end 156 and open at a top end 154. The wall 158 of the refuse container 152 also defines an outer surface 150 and an inner surface 154. The wall 158 also defines an inner cavity 162 into which refuse 199 can be deposited.

A trash bag 180 is positioned within the inner cavity 162 of the refuse container 152 such that the bag 180 rests substantially on the inner surface 160 of the wall 158 and the open top end 154 of the refuse container 152 remains open. The top portion of the trash bag 180 is folded over the top end 154 of the refuse container 152 and extended along an upper portion of the outer surface 150 of the wall 158.

As also shown in FIG. 2, the trash bag retainer 100 is stretched around the outer surface 150 of the wall 158, adjacent to the top end 154 of the refuse container 152. As such, the trash bag 180 is captured between the trash bag retainer 100 and the outer surface 150 of the wall 158. Specifically, when the trash bag retainer 100 is stretched around the outer surface 150, the trash bag 180 is captured between one side 120 of each engagement member 104 and the outer surface 150 of the wall 158. The elasticity of the band 102 rigidly holds the engagement members 104 up against the refuse container 152, thereby anchoring the trash bag 180 against the refuse container 152 at each of the engagement member 104 locations. As a result, the trash bag 180 is unlikely to fall inside the refuse container 162.

When the engagement members 104 abut the refuse container 152, one flat side 120 of each engagement member 104 extends vertically along the outer surface 150. As such, the trash bag retainer 100 is inhibited from rolling down the wall 158 of the refuse container 152. Therefore, the trash bag retainer 100 is more likely to stay in position and retain the trash bag 180, thereby advantageously keeping the trash bag 180 from falling into the inner cavity 162 of the refuse container 152.

As stated previously, each engagement member 104 extends outward from the axis 110 of the band 102. As a result, the axis 110 of the band 102 is separated from the outer surface 150 by a first distance 170. The diameter of the band 102 is generally small enough to create clearance between the outer surface 150 of the refuse container 152 and those segments of the band 102 extending between the engagement members 104. As such, the clearance provided by the first distance 170 creates a pathway for air that may otherwise be trapped between the inner surface 154 of the wall 158 and the trash bag 180. Thus, when refuse 199 starts to accumulate inside the inner cavity 162 of the refuse container 152, the refuse 199 is able to push air out from between the inner surface 154 and the trash bag 180. As such, the capacity of the inner cavity 162 of the refuse container 152 is unlikely to be limited by air pockets located underneath the trash bag 180.

Figure 3:
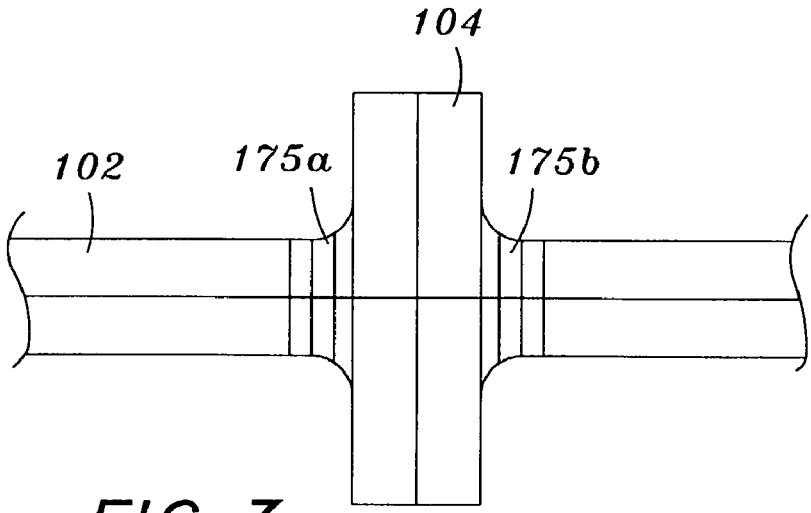
FIG. 3 is a detail view of the band and one reinforced engagement member of one embodiment of the trash bag retainer.

Turning now to FIG. 3, a detail view of a portion of the band 102 is shown along with a single engagement member 104. In this embodiment, the engagement member 104 is integrally connected to the band 102, and the junction between the engagement member 104 and the band 102 comprises opposing reinforcement portions 175*a*, 175*b*. In the embodiment shown, the band 102 has a constant diameter over much of its length, but the diameter of the band 102 increases consistently at locations immediately adjacent to the engagement member 104 in order to form the reinforcement portions 175*a*, 175*b*. The mean radius of each reinforcement portion 175*a*, 175*b* is about 0.46 inches. The reinforcement portions 175*a*, 175*b* provide added material strength to the trash bag retainer 100 in an area that might otherwise act as a failure point. Advantageously, the reinforcement portions 175*a*, 175*b* allow the trash bag retainer 100 to elongate to greater lengths without breaking, thereby allowing the trash bag retainer 100 to advantageously stretch around a wider variety of refuse containers 152.

Figure 4:
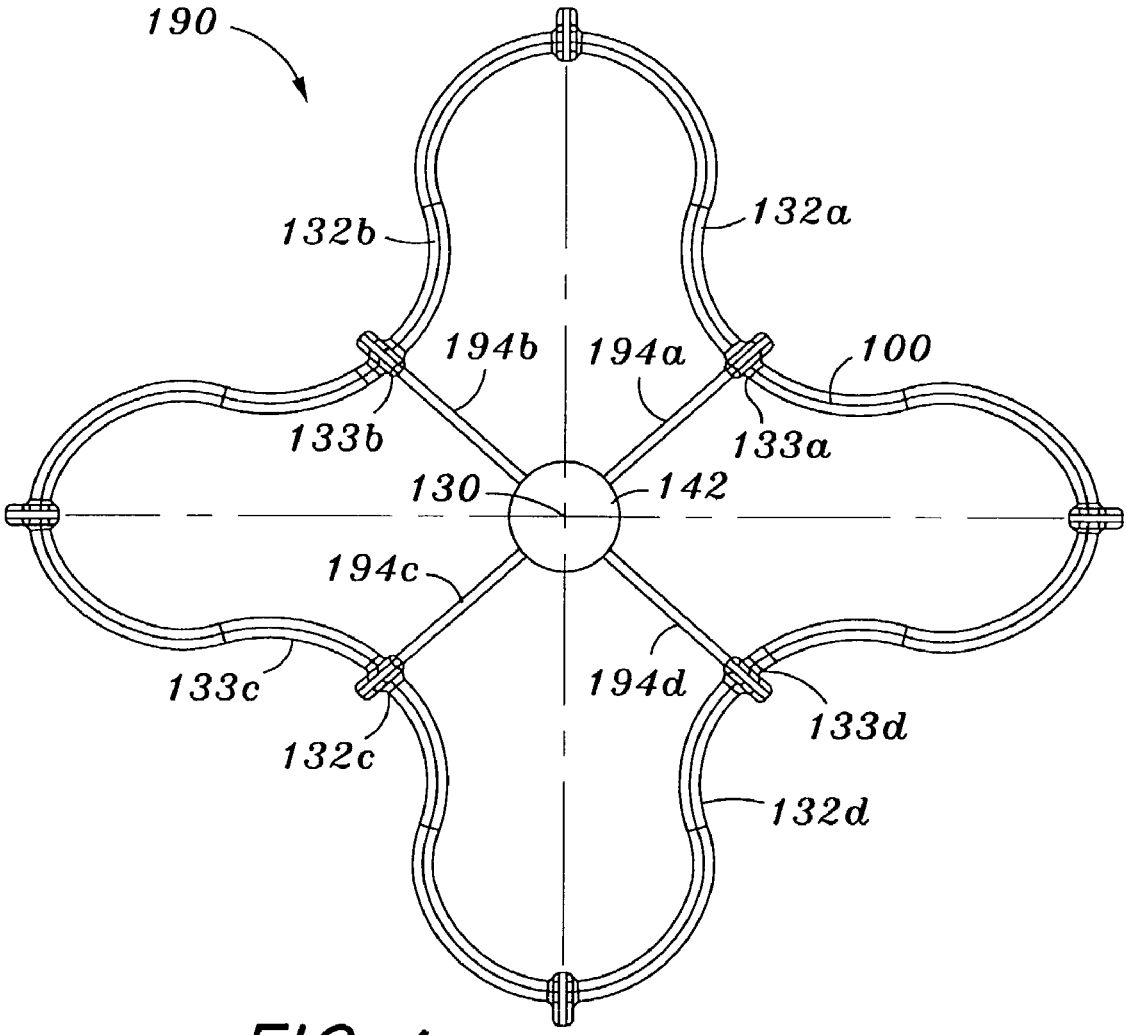
FIG. 4 is an isometric view of one embodiment of a molded, pre-cut trash bag retainer used to manufacture the trash bag retainer shown in FIGS. 1–3.

Turning now to FIG. 4, a pre-cut trash bag retainer 190 is illustrated. As will be described in greater detail below, the pre-cut trash bag retainer 190 represents the trash bag retainer 100 before its manufacturing process has been completed.

In this embodiment, the pre-cut trash bag retainer 190 comprises the trash bag retainer 100 as described above, but bent so as to define four inward radii 132*a*, 132*b*, 132*c*, 132*d*. Each inward radii 132*a*–132*d* is a bend in the trash bag retainer 100 which has a constant radius such that each inward radii 132*a*–132*d* comprises an apex 133*a*, 133*b*, 133*c*, 133*d* closer to the center point 130 than any other point on the pre-cut trash bag retainer 190. The inward radii 132*a*–132*d* are circumferentially spaced evenly around the center point 130.

In the embodiment shown in FIG. 4, the pre-cut trash bag retainer 190 also comprises a central structure 135. The central structure 135 comprises a central post 192, a cylinder positioned at the center point 130. The central structure 135 also comprises plurality of legs 194*a*, 194*b*, 194*c*, 194*d*, wherein each leg 194*a*–194*d* is a cylinder extending out from the central post 192 toward a respective one of the apexes 133*a*–133*d* of the inward radii 132*a*–132*d*. The legs 194*a*–194*d* are long enough to join the apexes 133*a*–133*d* to the central post 192. As will be discussed in greater detail below, the central structure 135 provides a flow path for an injection molding process.

The pre-cut trash bag retainer 190 is preferably formed by an injection molding process widely known in the art. Specifically, the injection molding process used to form the pre-cut trash bag retainer 190 involves preforming a mold with a cavity, wherein the walls of the cavity are formed in the shape of the band 102, the engagement members 104 and the central structure 135. Then, molten material is injected into such cavity. In a preferred embodiment, the injection of molten material occurs via the central structure 135. Once the molten material cools and hardens, ejection fins are used to facilitate the ejection of the trash bag retainer 190 from within the mold. Finally, the central structure 135 is cut from the trash bag retainer 100 at each apex 133*a*–133*d* to complete the manufacture of the trash bag retainer 100. Advantageously, this injection molding process is a cost-effective method of forming the trash bag retainer 100 in which the engagement members 104 are integrally joined to the band 102. The reinforcement portions 175*a*, 175*b* can be formed by simply altering the shape of the cavity in the mold.

In one particular embodiment, Versaflex™ material, manufactured by GLS Corporation, is used during the injection molding process in order to form the trash bag retainer 100. As indicated above, hardened Versaflex™ possesses desirable elastic qualities that allow the trash bag retainer 100 to elongate up to one hundred percent (100%) of its free length. Advantageously, this high degree of elasticity allows the trash bag retainer 100 to stretch around a wider variety of refuse container 152 sizes and shapes. Furthermore, Versaflex™ is normally transparent and can optionally be colored by adding dyes to the molten Versaflex™. As a result, the trash bag retainer 100 is likely to be more aesthetically pleasing to the user than the black trash bag retainers of the prior art.

Though not shown, it is contemplated that a second pre-cut trash bag retainer can be molded concurrently with the trash bag retainer 190 shown in FIG. 4. In this regard, the mold could be formed in a manner wherein such second trash bag retainer extends inwardly along, but in space relation to, the trash bag retainer 190. The second trash bag retainer would be identically configured to, but slightly smaller than, the trash bag retainer 190, with four of the engagement members of the second trash bag retainer being integrally connected to respective ones of the legs 194*a*–195*b*. Thus, a single mold could be used to concurrently form two trash bag retainers, i.e., the trash bag retainer 190 and the slightly smaller second trash bag retainer arranged in the same pattern as but positioned inwardly of the trash bag retainer 190. Following the same principal, the mold could optionally be formed to concurrently fabricate a third pre-cut trash bag retainer which is disposed outwardly of the trash bag retainer 190 in spaced relation thereto, yet extending in the same pattern and being integrally connected to the legs 194*a*–194*b*. Such outermost, third trash bag retainer, if included, would be slightly larger than the trash bag retainer 190. It will be recognized that virtually any number of trash bag retainers 190 could be concurrently formed through the use of a single mold, with trash bag retainers of progressively smaller size being nested within a larger trash bag retainer.

This disclosure provides exemplary embodiments of the present invention. The scope of the present invention is not limited by these exemplary embodiments. For instance, the trash bag retainer 100 could comprise a single engagement member 104 and a band 102 without departing from the spirit of the invention. Furthermore, the trash bag retainer 100 could comprise a non-continuous band 102 and not depart from the spirit of the invention. Still further, the trash bag retainer 100 could comprise engagement members 104 with a variety of non-triangular shapes without departing from the spirit of the invention. Numerous other variations, whether explicitly provided for by the specification or implied by the specification, such as variations in structure, dimension, type of material and manufacturing process may be implemented by one of skill in the art in view of this disclosure.

What is claimed is:

1. A trash bag retainer for maintaining a trash bag within a receptacle having a wall which defines a top rim and inner and outer surfaces, the retainer comprising:

an elongate band defining an axis, the band being extensible about the outer surface in a manner circumscribing the outer surface; and at least one engagement member attached to the band, the engagement member having a triangular configuration defining three engagement surfaces which are disposed outwardly of and collectively circumscribe the axis of the band such that any one of the engagement surfaces is extensible along the outer surface of the wall when the band is extended about the outer surface;

the engagement member being sized relative to the band and attached thereto such that a portion of the trash bag may be captured between any one of the engagement surfaces and the outer surface when the band is stretched to extend about the outer surface, and a gap is defined between at least a portion of the band and the outer surface of the wall when the band is extended thereabout.

2. The retainer of claim 1 wherein the band comprises a continuous, unitary structure.

3. The retainer of claim 1 wherein the band is of a first diameter, and defines a pair of reinforcement portions at opposed sides of the engagement member which are each of a second mean diameter exceeding the first diameter.

4. The retainer of claim 1 wherein the engagement member is integrally connected to the band, with the band and the engagement member being fabricated from a resilient material.

5. The retainer of claim 1 wherein the engagement member is centered on the axis of the band.

6. The retainer of claim 1 wherein a plurality of engagement members are attached to the band in spaced relation to each other.

7. The retainer of claim 6 wherein the engagement members are positioned in equidistantly spaced intervals along the band.

8. The retainer of claim 6 wherein each of the engagement members has a triangular configuration defining three engagement surfaces.

9. The retainer of claim 6 wherein the band comprises a continuous, unitary structure.

10. The retainer of claim 9 wherein the band is of a first diameter, and defines a pair of reinforcement portions at opposed sides of each of the engagement members, the reinforcement portions each being of a second mean diameter exceeding the first diameter.

11. A trash bag retainer for maintaining a trash bag within a receptacle having a wall which defines a top rim and an inner and outer surfaces, the retainer comprising:

an elongate band defining an axis, the band being extensible about the outer surface in a manner circumscribing the outer surface; and a plurality of engagement members attached to the band in equidistantly spaced intervals, each of the engagement members defining multiple engagement surfaces which are disposed outwardly of and collectively circumscribe the axis of the band such that any one the engagement surfaces of each of the engagement members is extensible along the outer surface of the wall when the band is extended about the outer surface;

the engagement members each being sized relative to the band and attached thereto such that portions of the trash bag may be captured between any one of the engagement surfaces of each of the engagement members and the outer surface when the band is stretched to extend about the outer surface, and the axis of the band is separated from and extends about the outer surface of the wall to create clearance between the outer surface and portions of the band extending between the engagement members when the band is extended about the outer surface.

12. The retainer of claim 11 wherein each of the engagement members has a triangular configuration defining three engagement surfaces.

13. The retainer of claim 11 wherein the engagement members are integrally connected to the band, with the band and the engagement members being fabricated from a resilient material.

14. The retainer of claim 11 wherein each of the engagement members is centered on the axis of the band.

15. The retainer of claim 11 wherein the band comprises a continuous, unitary structure.

16. The retainer of claim 15 wherein the band is of a first diameter, and defines a pair of reinforcement portions at opposed sides of each of the engagement members, each of the reinforcement portions being of a second mean diameter exceeding the first diameter.

17. A trash bag retainer in combination with a receptacle having a wall which defines a top rim and an outer surface, the retainer comprising:

an elongate band defining an axis, the band being disposed about and circumscribing the outer surface; and at least one engagement member attached to the band, the engagement member having a triangular configuration defining three engagement surfaces which are disposed outwardly of and collectively circumscribe the axis of the band such that any one of the engagement surfaces is extensible along the outer surface of the wall when the band is extended about the outer surface;

the engagement member being sized relative to the band and attached thereto such that a portion of the trash bag may be captured between any one of the engagement surfaces and the outer surface when the band is stretched over the outer surface, and a gap is defined between at least a portion of the band and the outer surface of the wall when the band is extended thereabout.

18. The retainer of claim 17 wherein the engagement member is integrally connected to the band, with the band and the engagement member being fabricated from a resilient material.

19. The retainer of claim 17 wherein the engagement member is centered on the axis of the band.

20. The retainer of claim 17 wherein a plurality of engagement members are positioned in equidistantly spaced intervals along the band.

21. The retainer of claim 20 wherein the engagement members are integrally connected to the band, with the band and the engagement members being fabricated from a resilient material.

22. The retainer of claim 17 wherein the band comprises a continuous, unitary structure.

23. The retainer of claim 22 wherein the band is of a first diameter, and defines a pair of reinforcement portions at opposed sides of the engagement member, each of the reinforcement portions being of a second mean diameter exceeding the first diameter.

* * * * *